US006072447A

United States Patent [19]

Noborio

[11] Patent Number: 6,072,447

[45] Date of Patent: Jun. 6, 2000

[54] PLASMA DISPLAY PANEL DRIVE CIRCUIT PROVIDED WITH SERIES RESONANT CIRCUITS

[75] Inventor: Masayuki Noborio, Tokyo, Japan

[73] Assignee: NEC Corporation, Tokyo, Japan

[21] Appl. No.: 09/200,741

[22] Filed: Nov. 30, 1998

[30] Foreign Application Priority Data

Nov. 28, 1997 [JP] Japan ..... 9-328830

[51] Int. Cl.[7] ..... G09G 3/28

[52] U.S. Cl. ..... 345/60; 345/68

[58] Field of Search ..... 345/60, 55, 61, 345/67, 68, 69; 315/169.1, 169.3, 169.4

[56] References Cited

U.S. PATENT DOCUMENTS

| | | | |
|---|---|---|---|
| 3,828,353 | 8/1974 | Kishi et al. | 345/60 |
| 4,866,349 | 9/1989 | Weber et al. | 345/60 |
| 5,867,135 | 9/1999 | Salavin et al. | 345/60 |
| 6,002,381 | 12/1999 | Tomio et al. | 345/60 |

FOREIGN PATENT DOCUMENTS

| | | |
|---|---|---|
| 2-66593 | 3/1990 | Japan . |
| 5-265397 | 10/1993 | Japan . |
| 6-130914 | 5/1994 | Japan . |
| 9-62226 | 3/1997 | Japan . |

*Primary Examiner*—Regina Liang
*Attorney, Agent, or Firm*—Sughrue, Mion, Zinn, Macpeak & Seas, PLLC

[57] ABSTRACT

A drive circuit for a plasma display panel is provided. A region of a plurality of surface discharge electrode pairs is divided such that the electrostatic capacitance between the surface discharge electrode pairs is divided into $2^n$ equal portions (where n is a natural number). $2^{n-1}$ series resonant circuits are formed by the capacitances of two each of the divided surface discharge electrode pair regions, a coil, and a plurality of switches. A first voltage state and a second voltage state between the plurality of surface discharge electrode pairs are shifted by the series resonant circuit.

8 Claims, 15 Drawing Sheets

PLASMA DISPLAY PANEL DRIVE CIRCUIT PROVIDED WITH SERIES RESONANT CIRCUITS

BACKGROUND OF THE INVENTION

1. Field of the Invention

The present invention relates to a drive method and circuit for a plasma display panel.

2. Description of the Related Art

Plasma display panels typically offer many features including thin construction, lack of flicker, and high display contrast ratio, and in addition are relatively amenable to large screen applications. They have a high response speed, and in self-emitting types can emit polychromatic light by using a fluorescent. As a result, plasma display panels are becoming increasingly widely used in recent years in the fields of computer-related display devices and color image display devices.

Depending on the method of operation, plasma display panels can be divided between the AC drive type, in which electrodes are covered by a dielectric and alternating-current discharge occurs indirectly, and the DC drive type, in which the electrodes are exposed in a discharge space and direct-current discharge occurs directly. The AC drive type can prevent sputtering of the electrode that is caused by discharge and therefore features longer life. Depending on the drive method for sustaining discharge, this type can be further divided between a paired type in which discharge occurs between confronting opposed electrodes, and a surface discharge type in which discharge occurs between surface discharge electrodes formed on the same substrate.

FIG. 1 presents a sectional view of a display cell constituting an AC-drive surface discharge plasma display panel. This display cell consists of: two insulating substrates 1 and 2 composed of glass, one being the rear surface and the other being the front surface; transparent scan electrode 3 and transparent sustain electrode 4 formed on insulating substrate 1; trace electrodes 5 and 6 layered so as to overlap with scan electrode 3 and sustain electrode 4 and provided for reducing the electrode resistance of scan electrode 3 and sustain electrode 4; dielectric 12 that covers scan electrode 3, sustain electrode 4, and trace electrodes 5 and 6; protective layer 13 composed of a material such as magnesium oxide that is layered on this dielectric 12 to protect dielectric 12 from discharge; data electrode 7 formed on insulating substrate 2 in a direction orthogonal to scan electrode 3 and sustain electrode 4; dielectric 14 that covers data electrode 7; barrier ribs 9 provided on dielectric 14 for both establishing the discharge gas spaces 8 and demarcating display cells; phosphor 11 coated onto dielectric 14 and the side walls of barrier ribs 9 for converting the ultraviolet rays generated by the discharge of discharge gas filing the discharge gas space 8 into visible light 10; and discharge gas space 8 between insulating substrates 1 and 2 that is filled with discharge gas composed of, for example, helium, neon, and xenon or a compound of these gases.

Referring to FIG. 1, explanation is next presented regarding discharge in a selected display cell. When discharge is initiated by the application of a pulse voltage that exceeds the discharge threshold between scan electrode 3 and data electrode 7, a positive or negative charge is drawn to the surfaces of dielectric 12 and 14 on both sides corresponding to the polarity of the pulse voltage to bring about accumulation of charge. The equivalent internal voltage brought about by this accumulation of charge, i.e., the wall potential, is of the reverse polarity of the above-described pulse voltage. As a result, the effective voltage inside the cell decreases as discharge grows, and even if the above-described pulse voltage is maintained at a fixed value, discharge cannot be sustained and eventually comes to an end.

If a sustain pulse, which is a pulse voltage of the same polarity as the wall potential, is subsequently applied between adjacent scan electrode 3 and sustain electrode 4, the wall potential portion combines with this sustain voltage as the effective voltage to exceed the discharge threshold value even if the sustain pulse applied from the outside has a small voltage amplitude, and discharge can therefore be achieved. Discharge can thus be sustained by continuing to apply sustain pulses between scan electrode 3 and sustain electrode 4. This capability constitutes the memory function. In addition, the above-described sustain discharge can be halted by applying to scan electrode 3 or sustain electrode 4 an eraseing pulse, which is a wide and low-voltage pulse that neutralizes the wall potential or a narrow pulse having a voltage on the order of the sustain pulse.

The effective voltage to be applied to a cell remote from the input terminal portion of a large-area display panel is decreased due to the voltage drop across electrode wiring resistance, and this decrease may result in non-uniformity in the emitted luminance within the panel. Since wall potential proportional to the applied voltage is stored in the above-described AC drive, the input terminals of scan electrodes and sustain electrodes that form pairs can be arranged on mutually different panel end portions, whereby the voltage that is effectively applied to a cell can be made substantially uniform in the vertical direction of the panel, thereby allowing prevention of variations in display luminance, which is one cause of loss in panel quality.

FIG. 6 shows an example of the drive waveform applied to each electrode when driving a plasma display having a j×k (j, k being natural numbers) dot matrix. Wu is the waveform of the sustain electrode voltage applied in common to sustain electrodes; Ws1, Ws2, . . . , Wsj are the waveforms of scan electrode drive voltage applied to each of a number j of scan electrodes; and Wd is the waveform of the data electrode drive voltage applied to the data electrodes. One drive period consists of priming discharge interval A, writing discharge interval B, and sustain discharge interval C, and a desired image display is obtained by repeating these cycles.

Priming discharge interval A is an interval for generating active particles and wall charge within the discharge gas space so as to obtain stabilized writing discharge characteristics during writing discharge interval B. In priming discharge interval A, priming discharge pulses Pp+ and Pp− are applied to cause all display cells to discharge simultaneously, following which priming discharge eraseing pulse Pe is applied to all scan electrodes simultaneously to erase any charge of the wall charge generated by priming discharge interval A that would hinder writing discharge and sustain discharge. In other words, after first applying priming discharge pulses Pp+ and Pp− to surface discharge electrodes to bring about discharge in all display cells, priming discharge eraseing pulse Pe is applied to scan electrodes to cause erase discharge to erase wall charge that has accumulated due to the priming discharge pulse.

In writing discharge interval B, scan base pulse Pb is first applied to all scan electrodes, following which sequential scan pulse Pw is applied to each scan electrode and a data pulse Pd is selectively applied synchronously with this scan pulse Pw to the data electrodes of display cells that are to display, thereby bringing about writing discharge and generating wall charge in cells that are to display.

Scan base pulse Pb decreases the value of scan voltage Pw, thereby lowering the maximum voltage employed in the drive IC of high withstand voltage that generates scan pulse Pw, and is directed to realizing a low-cost IC. When the value of scan pulse Pw is high, discharge occurs with the rise of scan pulse Pw. This is a harmful discharge that erasees the writing discharge caused by the scan pulse and data pulse. The scan base pulse prevents this harmful discharge by lowering the value of scan pulse Pw.

In sustain discharge interval C, first sustain pulse string Ps1 is applied to sustain electrode and second sustain pulse string Ps2, which has a 180° phase delay with respect to first sustain pulse string Ps1, is applied to each scan electrode, thereby sustaining the necessary sustain discharge to obtain the desired luminance for the display cells in which writing discharge was carried out in writing discharge interval B.

In an AC-drive surface discharge plasma display panel, the surface discharge electrodes made up of scan electrodes and sustain electrodes are both covered with a dielectric, and as a result, the capacitance component is large and the power loss from voltage pulses therefore cannot be ignored. When a sustain voltage pulse of voltage Vs and repetition frequency f is applied between scan and sustain electrodes, the energy P supplied from the power source upon charging or discharging inter-electrode capacitance CP can be represented by equation (1):

$$P=Cp\times Vs^2\times f \quad (1)$$

This energy P plays no part in gas discharge and is consumed by the resistance of switching elements or panel wiring resistance. Increasing panel size entails not only an increase in the panel capacitance, but an increase in the number of switching elements due to the increase in the gas discharge current, and this is accompanied by an increase in wiring resistance. These factors contribute to both massive power source circuits as well as to display elements having poor energy efficiency due to increase in the total energy consumption.

Plasma display panel drive circuits intended to eliminate ineffectual energy consumption are disclosed in, for example, Japanese Patent Laid-open No. 265397/93 (first example of the prior art) and Japanese Patent Laid-open No. 152865/96 (second example of the prior art).

FIG. 4 is a schematic view of a plasma display panel display device in which the drive circuit of the first example of the prior art is connected to a plasma display panel. Plasma display panel 110 comprises: a plurality of surface discharge electrode pairs made up of scan electrodes and sustain electrodes that are parallel in the horizontal direction and connected in the vertical direction; and a plurality of data electrodes that are parallel in the vertical direction and connected in the horizontal direction and that form pixels at the intersections with the plurality of surface discharge electrode pairs; and includes on opposing panel end portions on the same flat surface the voltage input terminals of the scan electrodes and sustain electrodes that form pairs. Data driver 105 that generates data pulses is connected to plasma display panel 110. The sustain electrodes are connected to sustain driver 101, power recovery circuit 102, and external capacitance 115, and the scan electrodes are connected to sustain driver 108, power recovery circuit 107, and external capacitance 116 by way of scan driver 109.

FIG. 2 is a circuit diagram of the drive circuit of the plasma display device of the first example of the prior art that eliminates ineffectual power consumption. Power recovery circuit 102 consists of coil L201, switches SW201 and SW202, and diodes D201 and D202 for preventing current in the reverse direction; power recovery circuit 107 consists of coil L202, switches SW203 and SW204, and diodes D203 and D204; while sustain drivers 101 and 108 are of push-pull type and consist of two switches SW205 and SW206, and SW207 and SW208, respectively, that connect the power source lines and ground lines.

In the interest of clarifying the power recovery operation during sustain pulse driving, the priming discharge circuit for bringing about generation of stabilized writing discharge and the scan driver have been omitted, and the panel has been simplified as panel capacitance CP201, which is the capacitance between the scan and sustain electrodes.

The power recovery operation when applying sustain voltage pulses of positive polarity to the first example of the prior art is next explained with reference to FIG. 2. Power collecting electrolytic capacitors C201 and C202 are connected in common to one end of power recovery circuit 102 and 107. In this drive circuit, switch SW202 is first turned ON to raise sustain pulses in the sustain interval when switches SW205 and SW206 are OFF and the voltage of the electrodes is 0V, and charge from capacitor C201, which has stored half the voltage of sustain voltage Vs in advance, is supplied by way of diode D202 and coil L201. Coil L201 and panel capacitance CP201 hereupon resonate, the panel electrode potential is raised to close to the level of Vs, and this voltage combined with the wall potential brings about sustained discharge. When the sustain pulse is caused to fall, switches SW202 and SW205 first turn OFF in succession, following which switch SW201 turns ON and charge stored in panel capacitance CP201 passes by way of coil L201 and diode D201 to be collected in capacitor C201. The output potential to the panel drops to close to 0V, whereupon switch S206 turns ON and the potential is decreased all the way to 0V. Switches SW201 and SW206 then turn OFF in succession. The foregoing explanation relates to the recovery operation for the circuit that is connected to coil L201, but the operation of the circuit connected to coil L202 is equivalent with the exception that the repetition period of the sustain voltage pulses is shifted by a half-period.

FIG. 5 is a schematic diagram of a plasma display device in which the circuit of the second example of the prior art is connected to a plasma display. Power recovery circuit 107 in this drive circuit is connected in parallel to panel 110, and external capacitors C201 and C202 of the first example of the prior art are not required.

FIG. 3 shows a plasma display panel drive circuit for a case in which sustain pulses of negative polarity are applied using the second example of the prior art. As in FIG. 2, the scan driver is omitted and the panel capacitance is abbreviated as CP202.

A power recovery circuit comprises: a charging/discharging circuit section including a coil L203 and switches SW211 and SW212 that recharge panel capacitance CP202 to an opposite polarity with the resonant current that is generated when applying sustain pulses, and diodes D205 and D206 for preventing reverse current; and a voltage clamping section for clamping the voltage across panel capacitance CP202 to the power source voltage and to the power source voltage of the opposite polarity and having four switches SW209, SW210, SW213, and SW214 connected between the power source and each end of panel capacitance CP202. Panel capacitance CP202 and the power recovery circuit constitute a resonant circuit. Resonance is caused by the ON and OFF combination of four switches SW209, SW210, SW213, and SW214 when charging/discharging the panel capacitance, and power is recovered by charging the electric charge discharged from the panel in the panel itself.

One problem encountered in the first example of the prior art is that the power collecting capacitors must have sufficient capacitance for the load capacitance, and therefore require time to attain a stabilized state. In addition, driving a large-screen plasma display panel necessitates external capacitors of large capacitance, and this requirement can offset the space saved, which is the chief feature of a flat display. This is because no charge is stored in the capacitors when the power source is powered up and some time is therefore needed before the drive voltage reaches half the voltage that charges the panel capacitance. To quickly obtain stabilized operation, either a separate-system power source must be prepared for supplying in advance from the outside the voltage of half the value for charging the panel capacitance, or a start-up circuit must be provided that can separately supply a kick pulse to the power recovery capacitor. A further disadvantage of this construction is the large number of constituent elements.

The disadvantage of the second example of the prior art is that the power recovery circuit must be provided in parallel with the panel, and connections must be provided between sustain drivers 101 and 108 connected at the two ends of the panel as shown in FIG. 5. The problem in this case lies in the wiring that connects the panel terminals for forming the resonant circuit that is in parallel with the panel capacitance when carrying out recovery. A power recovery circuit can be formed with few components by forming a resonant circuit in parallel with the panel capacitance, but a high peak current flows through the wiring for forming the resonant circuit when charging/discharging and the current path is substantially equal to the panel length. When constructing a large-screen display device, both the electromagnetic wave noise caused by the current flowing through the wiring and the wiring impedance must therefore be taken into consideration, and limitations are also imposed by, for example, the rise of pulses and power loss due to wiring resistance.

SUMMARY OF THE INVENTION

It is at object of the present invention to provide a plasma display panel drive method and circuit along with a plasma panel display device that: eliminate ineffectual power consumption generated by voltage pulses due to the large panel capacitance in a panel construction, thereby promoting power saving; that minimize the length of wiring through which a high peak current flows that is brought about upon applying voltage; that reduce the effect of electromagnetic waves caused by current flowing through wiring; and moreover, that achieve these objects with few circuit components.

To achieve these objects, in present invention, a region of a plurality of surface discharge electrode pairs is divided such that the electrostatic capacitance between surface discharge electrode pairs is divided into $2^n$ equal portions, where n is a natural number, $2^{n-1}$ series resonant circuits are formed from the electrostatic capacitance of two each of the divided surface electrode pair regions, a coil, and a plurality of switches; and a first voltage state and a second voltage state between the plurality of surface discharge electrodes are shifted by means of the series resonant circuits.

By connecting power recovery circuits (series resonant circuits) made up of a coil and a plurality of switches between panels in which capacitance is divided into two equal portions, charge to be stored in the panels can be exchanged between both panels, thereby allowing a reduction of ineffectual power that is lost in charging/discharging panel capacitance and that does not contribute to light emission.

In addition, when driving a large-screen plasma display panel, the plasma display panel drive circuit of the present invention does not require connection of large-capacity electrolytic capacitors, which can detract from the space-saving feature of a plasma display panel.

Moreover, circuits of large-area capacitive display load in which the light emission current is high tend to be expensive, and there is consequently no need to add wiring that runs parallel to the panel when driving by dividing the sustain drivers. In addition, driving by dividing into two portions by necessity results in current that flows in opposite directions, and a construction can therefore easily be realized in which wiring inside the panel is alternated to offset the effect of electromagnetic waves caused by current flowing through the inner panel wiring.

One row or more of the surface discharge electrode pairs connected in the column direction may be taken as one set, and these surface discharge electrode pair sets may then be divided between odd-numbered sets and even-numbered sets.

In the series resonant circuits, wiring connected to the electrostatic capacity of two divided surface discharge electrode pair regions with an interposed coil may be connected to a voltage input terminal on the same panel end portion.

A series resonant circuit comprise a first series-parallel circuit may in which a first diode and a first switch element connected together in a series, and a second diode and a second switch element connected together in a series, are connected together in parallel, and in which the direction of current flow in the first diode is the reverse of the direction of current flow in the second diode, and a second series-parallel circuit in which a third diode and a third switch element connected together in a series, and a fourth diode and a fourth switch element connected together in a series, are connected together in parallel, and in which the direction of current flow in the third diode is the reverse of the direction of current flow in the fourth diode. The first end of the first series-parallel circuit is connected by way of first wiring to the first electrode of the first electrostatic capacitance of two divided surface discharge electrode pair regions. The second end of the first series-parallel circuit is connected by way of second wiring to the first electrode of the second electrostatic capacitance. The first end of the second series-parallel circuit is connected by way of third wiring to the second electrode of the first electrostatic capacitance. The second end of the second series-parallel circuit is connected by way of fourth wiring to the second electrode of the second electrostatic capacitance. Finally, the series-parallel resonant circuit includes a coil connected in series to at least one wiring of the first wiring to fourth wiring.

Each time the two divided display load capacitances are charged/discharged, a resonant circuit made up of a coil and two capacitances combined with switches is formed, and the charge discharged from one of the capacitance divisions simply charges the other capacitance division. At the next instance of charging, charge discharged from the other capacitance division is used. Charge thus moves repeatedly between two capacitances.

The above and other objects, features, and advantages of the present invention will become apparent from the following description with reference to the accompanying drawings which illustrate examples of the present invention.

DETAILED DESCRIPTION OF THE PREFERRED EMBODIMENTS

Figure 7:
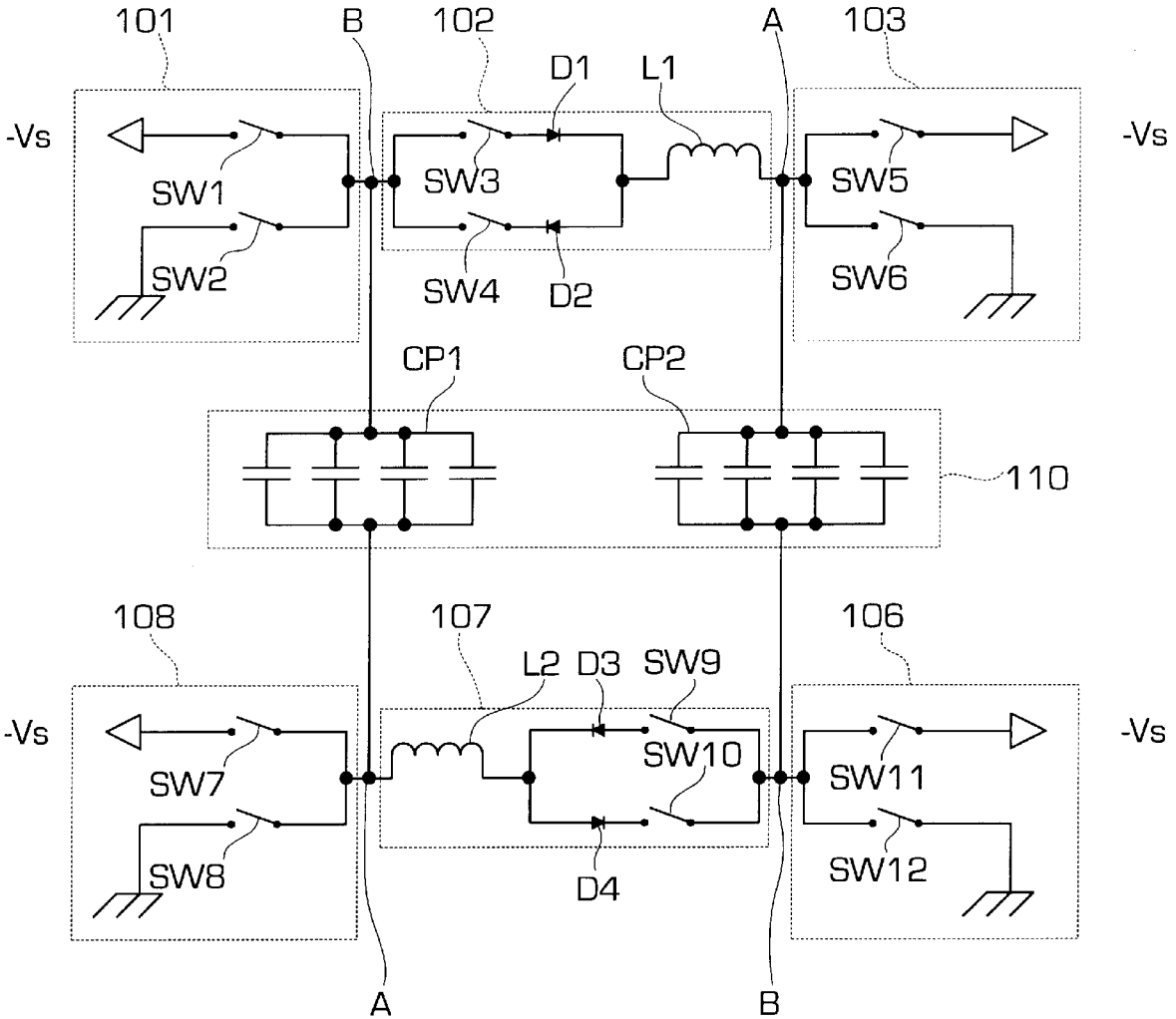
FIG. 7 is a circuit diagram of a circuit of the present invention for realizing power recovery of capacitive load.

Referring now to FIG. 7, there is shown a plasma display panel drive circuit according to the first embodiment of the present invention. The plasma display drive circuit includes sustain drivers 101, 103, 106, and 108 and power recovery circuits 102 and 107.

Two circuits composed of coils L1 and L2, switches SW3, SW4, SW9, and SW10 and diodes for preventing reverse current D1, D2, D3, and D4 are each connected to divided panel capacitances CP1 and CP2 to form series resonant circuits. In addition, the two ends of each of panel capacitances CP1 and CP2 are connected to switches SW1, SW2, SW5, SW6, SW7, SW8, SW11, SW12 that are in turn connected to either power source lines or ground lines. Resonance by the series resonant circuits is brought about by the ON and OFF combination of switches SW1~SW12 each time these panel capacitances CP1 and CP2 are charged or discharged. Essentially, upon discharge of the electric charge from one divided panel portion, the other divided panel portion is charged simply by the thus-discharged electric charge and polarity is inverted, and, conversely, to charge the one divided panel portion, electric charge discharged from the other divided panel portion is used. This operation is repeated. Power for charging/discharging supplied to the panel from the power source lines is thus reduced, and the power consumption required for driving can be cut.

Figure 8:
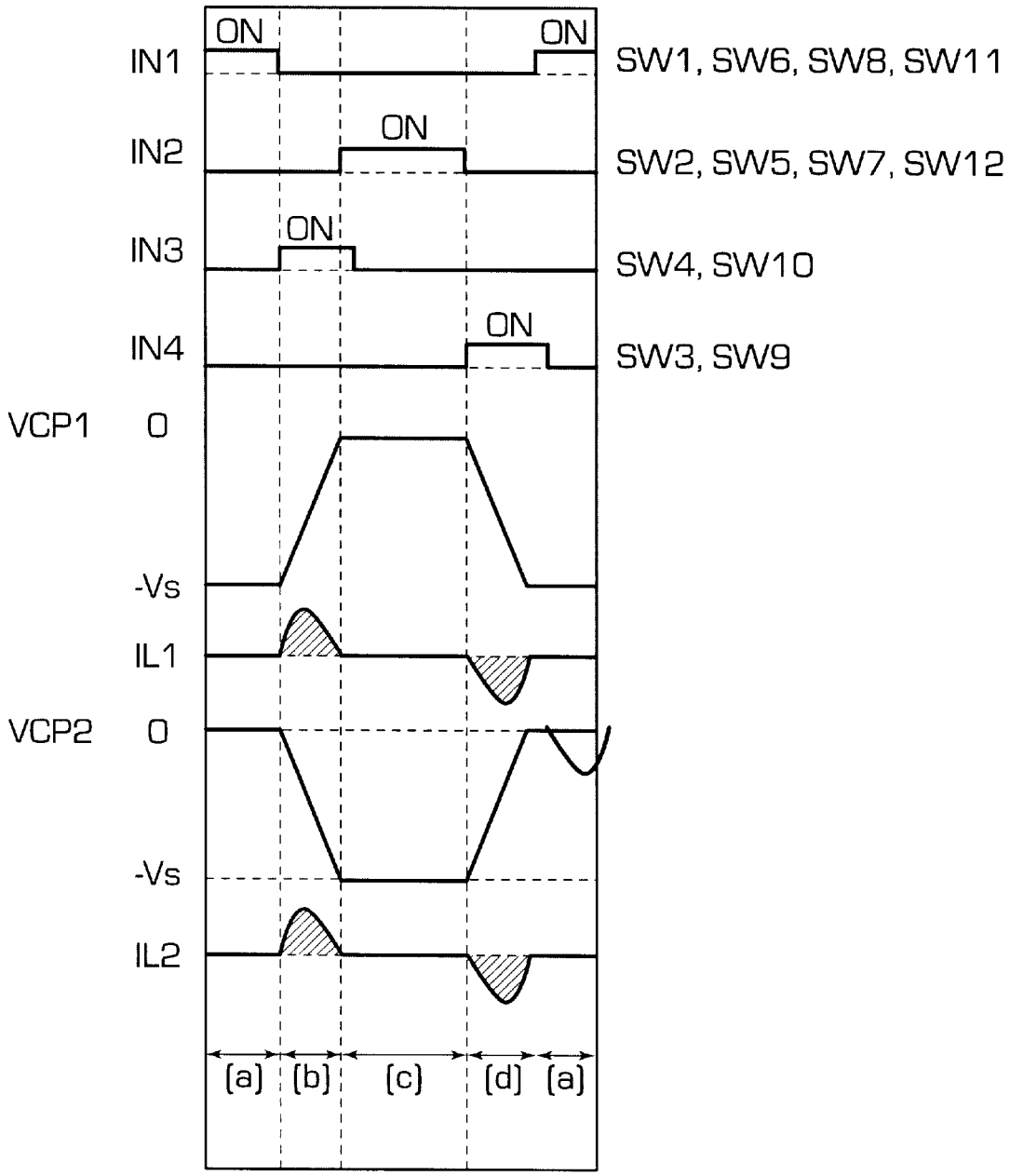
FIG. 8 is a waveform chart of the drive voltage and drive current of the capacitive load in FIG. 7.

Explanation is next presented for a case in which sustain pulses of negative polarity are applied using FIG. 8 and FIG. 9. FIG. 8 is a waveform chart of the drive voltage and drive current of the capacitive display load in the first embodiment. As shown in FIG. 8, IN1–IN4 are input waveforms that operate switches SW1–SW12 in FIG. 7, VCP1 and VCP2 are the voltage waveforms at points A and points B, respectively, and IL1 and IL2 show the current waveforms flowing to coils L1 and L2.

Figure 9A:
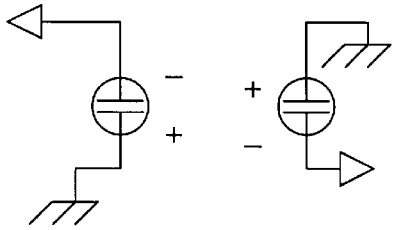
FIGS. 9A–9D are explanatory views of the circuit operation corresponding to each of intervals a, b, c, and d in FIG. 8.

FIGS. 9A–9D illustrate the circuit operation at each of the intervals a, b, c, and d shown in FIG. 8. Interval a begins from a state in which no electric charge has been charged into the panel at start time (t=0). When switches SW1 and SW6 and switches SW8 and SW11 are closed, divided panel capacitances CP1 and CP2 are each connected between the ground and power source (−Vs), and electric charge of the polarity shown in the figure is charged to panel capacitances CP1 and CP2 by the flow of charging current. This state is shown in FIG. 9A. At this time, switches SW2, SW3, SW4, SW5, and switches SW7, SW9, SW10, and SW12 are in an open state. In the following description, switches are assumed to be open unless stated otherwise.

Figure 9B:
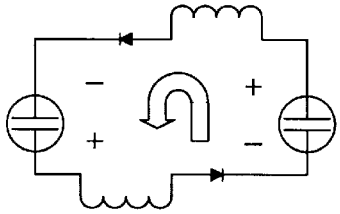
Figure 9C:
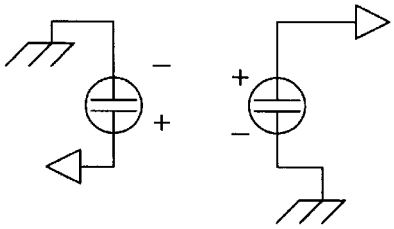
Figure 9D:
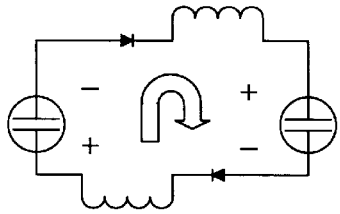

Next, as shown in FIG. 9B, in interval b switches SW1 and SW6 and switches SW 8 and SW11 are opened, following which switches SW4 and SW10 are closed, and current flows to coils L1 and L2 in the direction of the arrows shown in the figure. At the same time, a back electromotive force is generated in coils L1 and L2 and a resonant current flows. The current flowing to panel capacitances CP1 and CP2 eventually becomes zero, and a maximum reverse voltage is applied to panel capacitances CP1 and CP2. Next, switches SW4 and SW10 are opened and switches SW5 and SW7 and switches SW2, SW12 are closed, whereupon the switch SW5 and switch SW7 sides of panel capacitances CP1 and CP2 are clamped to the power source voltage (FIG. 9C). At this time, the polarity of the electric charge stored in panel capacitances CP1 and CP2 is opposite to the polarity shown in FIG. 9A. Closing switches SW3 and SW9 then creates a resonant circuit that is formed by SW3, D1, L1, SW9, D3, L2 and panel capacitances CP1 and CP2 as shown in FIG. 9D, current flows in the reverse direction of interval b, and panel capacitances CP1 and CP2 are recharged to the opposite polarity. Finally, switches SW3 and SW9 are opened, switches SW1 and SW8 and switches SW6 and SW11 are closed, whereupon the switch SW1 and switch SW11 sides of panel caparitances CP 1 and CP 2 are clamped to the power source voltage and electric charge is stored as shown in FIG. 9A. Operation thereafter continues by repeating the internals (a)–(d).

Figure 10:
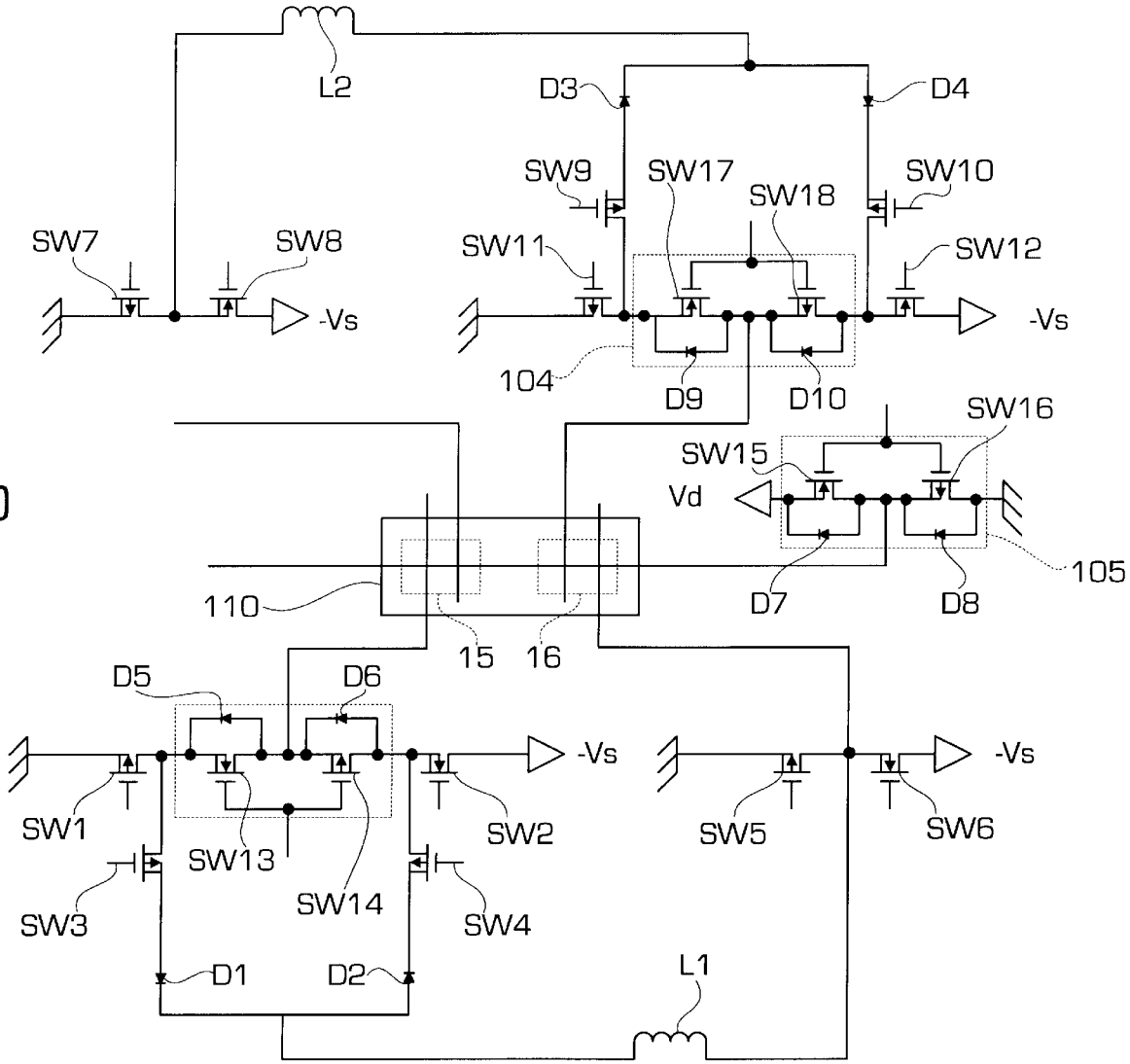
FIG. 10 is a schematic circuit diagram of the plasma display panel drive circuit according to one embodiment of the present invention.

Referring to FIG. 10, there is shown a schematic structural view of the drive circuit of an AC-drive surface discharge plasma display panel display device according to the present invention for pixels 15 and 16 that are connected to the same data driver that supplies data voltage corresponding to display data. The same reference numerals are used for components that are common to the circuit diagram shown in FIG. 7 to facilitate understanding of the operation.

Switches SW1–SW18 are MOSFETs which are switch elements, D1–D6 are diodes, and L1 and L2 are coils. In addition, the capacitances between scan and sustain electrodes that pass through each of pixel 15 and pixel 16 correspond to CP1 and CP2 of FIG. 7. Scan drivers 104 and 109 shown in the figure are circuits made up of push-pull circuits and usually employ integrated ICs. Scan drivers 104 and 109 are intended to output scan pulses for writing display data to the pixels during the scan interval to one of two electrodes that pass through pixels 15 and 16. Data electrodes that input in common to pixels 15 and 16 are connected to data driver 105. Scan driver 104 is made up of switches SW 17 and SW18 and diodes D9 and D10. scan driver 109 is made up of switches SW13 and SW14 and diodes D5 and D6. Data driver 105 is made up of switches SW15 and SW16 and diodes D7 and D8.

As explained in the aforementioned embodiment, switching is realized by MOSFETs, and the electric charge discharged from one capacitance is moved to the other capacitance by the resonance of a coil arranged in a series with panel capacitance, and the polarity is inverted. In accordance with the ON/OFF intervals of FIG. 8, voltage is applied to the gates of MOSFET SW1, SW5, SW7, SW11.

Figure 11:
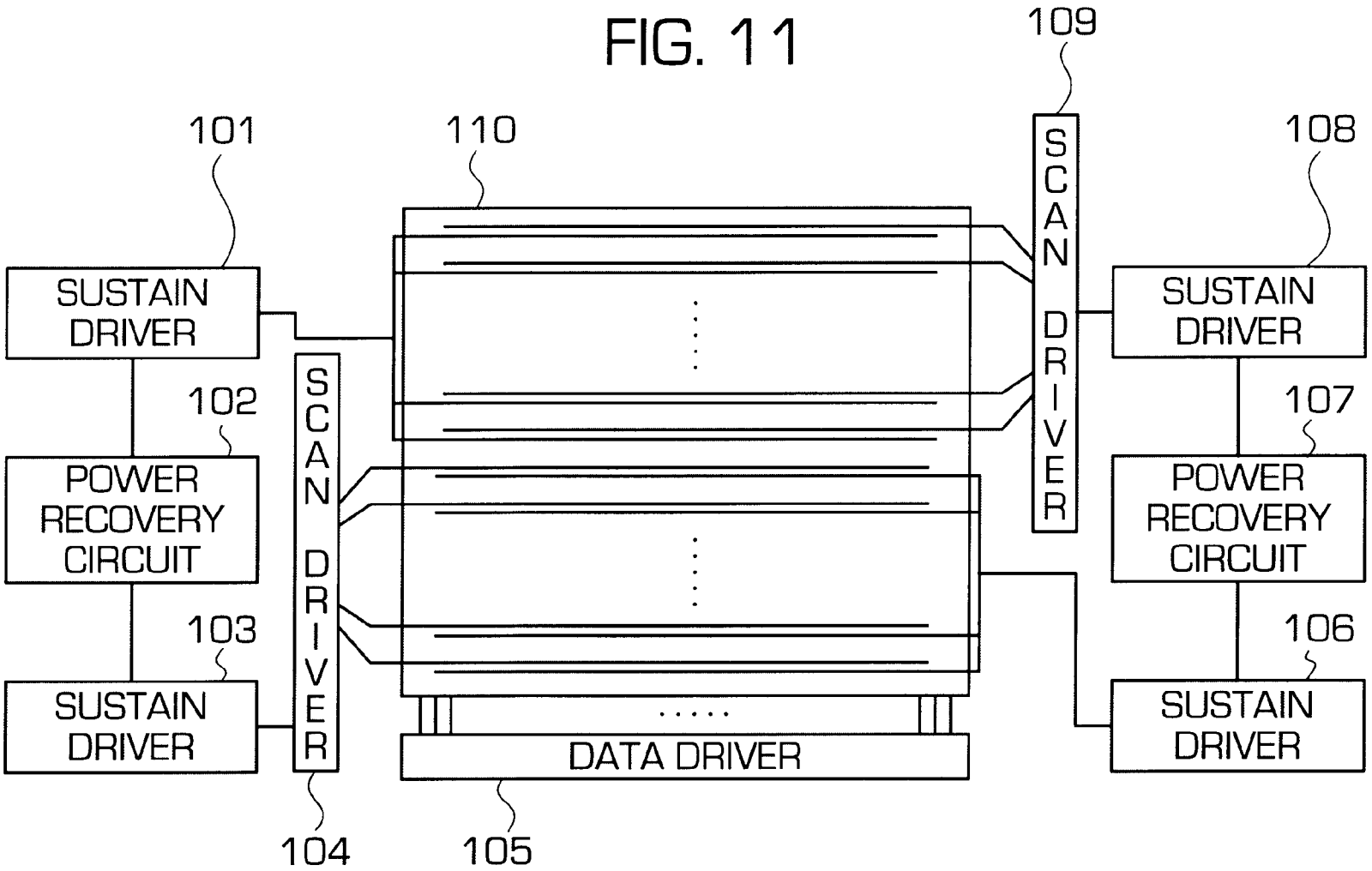
FIG. 11 is a schematic view of the plasma display panel display device according to the first embodiment of the present invention.

FIG. 11 shows a schematic view of the plasma display panel display device according to the first embodiment of the present invention. The panel region is divided into two equal portions in the horizontal direction such that capacitances are equal. For example, a VGA panel (640×480 dots) is divided between an upper portion of (640×240) and a lower portion of (640×240).

First sustain driver 101 is connected to the common sustain electrode terminal led out on the left end of the upper panel portion, to second sustain driver 103 with first power recovery circuit 102 made up of coil and switches interposed between first sustain driver 101 and second sustain driver 103, and finally, by way of scan driver 104, to the scan electrode terminal led out on the left end of the lower panel portion. The common sustain electrodes which are paired with scan electrodes connected to scan driver 104 are led out from the right end of the lower panel portion, and this electrode terminal is connected to third sustain driver 106. Second power recovery circuit 107 is interposed between sustain drivers 106 and 108, and fourth sustain driver 108 is connected by way of scan driver 109 to scan electrodes that are paired with the common sustain electrodes connected to first sustain driver 101. In the present embodiment, sustain pulses having pulse potentials of two potentials −Vs and 0V are supplied periodically, and the polarities of the electric charge stored in the upper portion and in the lower portion must be different in order to realize the upper and lower divided regions having equal panel capacitance by the construction shown in FIG. 11. In addition, because of the difference in polarity of the electric charge stored between scan and sustain electrodes that form electrode pairs in the upper portion, voltage input terminals to the scan electrodes and sustain electrodes are preferably different on the upper portion and lower portion.

In this embodiment, explanation has been presented using the directions upper and lower, right and left that correspond to the figures for the sake of explanation, but it should be obvious that the same effect can be obtained even in a circuit having differences in construction with respect to upper and lower or left and right as long as the connection relationships remain the same.

Figure 12:
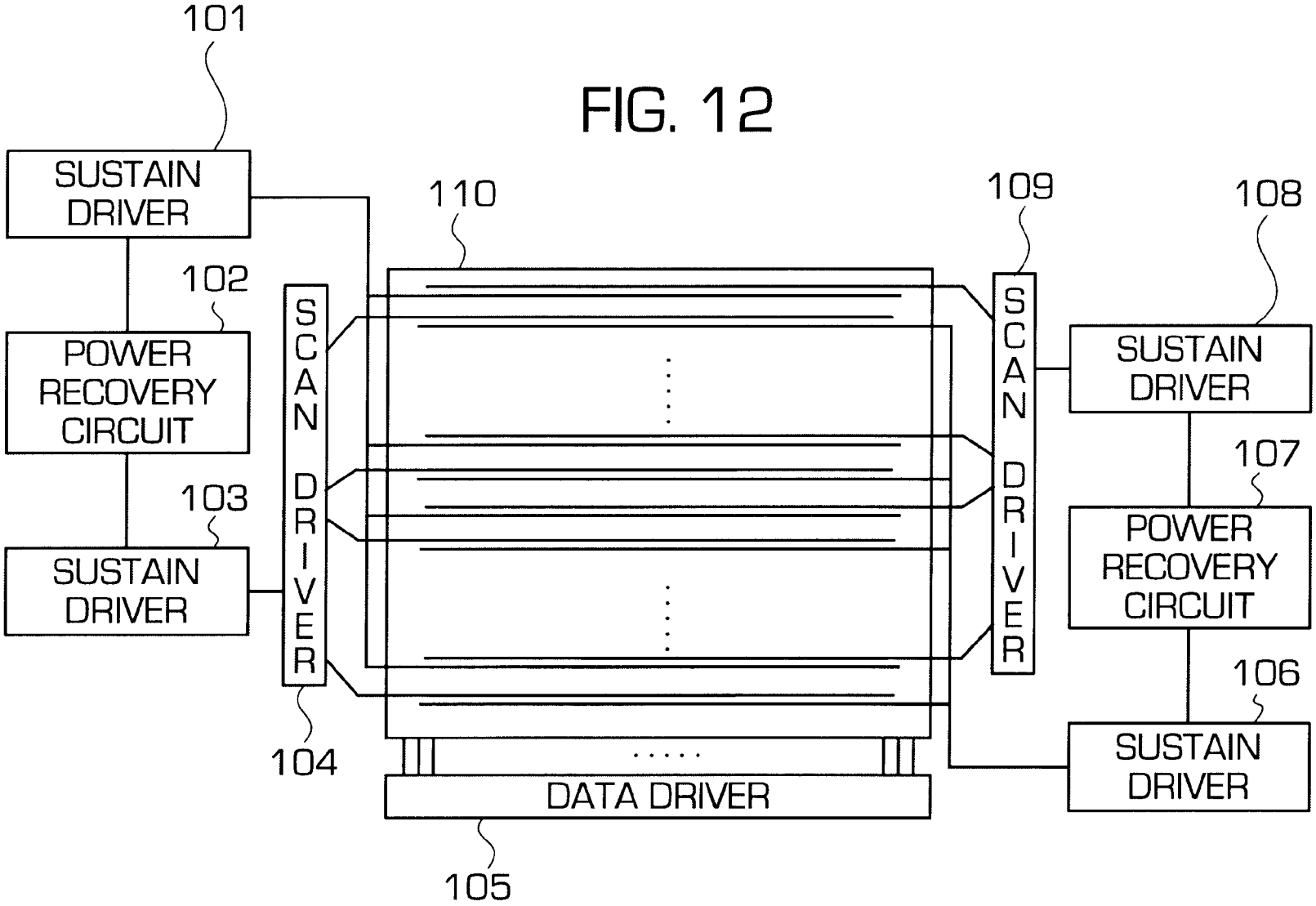
FIG. 12 is a schematic view of the plasma display panel display device according to the second embodiment of the present invention.

Detailed explanation is next presented regarding the second embodiment of the present invention with reference to FIG. 12. Components of the second embodiment that are equivalent to those of the above-described first embodiment are identified by the same names and reference numerals and detailed explanation regarding these components is omitted.

Power recovery circuit 102 is connected between the two sustain drivers 101 and 103 that drive one divided panel region, and power recovery circuit 107 is connected between the two sustain drivers 106 and 108 that drive the other divided panel region, and the panel capacitance is divided between two systems constituted by the even-numbered rows and odd-numbered rows of surface discharge electrode pairs. Operation similar to that of the first embodiment can thus be obtained despite the difference in the method of division. Accordingly, the polarity of electric charge stored to the panel capacitance is inverted by the transfer of electric charge between the two systems, and the amount of power supplied from the power source can be reduced. Further, the charging/discharging current flows to the scan electrodes and sustain electrodes in directions that reverse with each row, thereby reducing the electromagnetic noise caused by current flowing through in panel wiring. Although the panel capacitance is divided between even-numbered and odd-numbered rows of surface discharge electrode pairs in FIG. 12, the same effect can be obtained if the capacitance is divided into two portions by grouping the surface discharge electrode pairs into sets of a plurality of pairs each and then arranging these sets to alternate.

Figure 1:
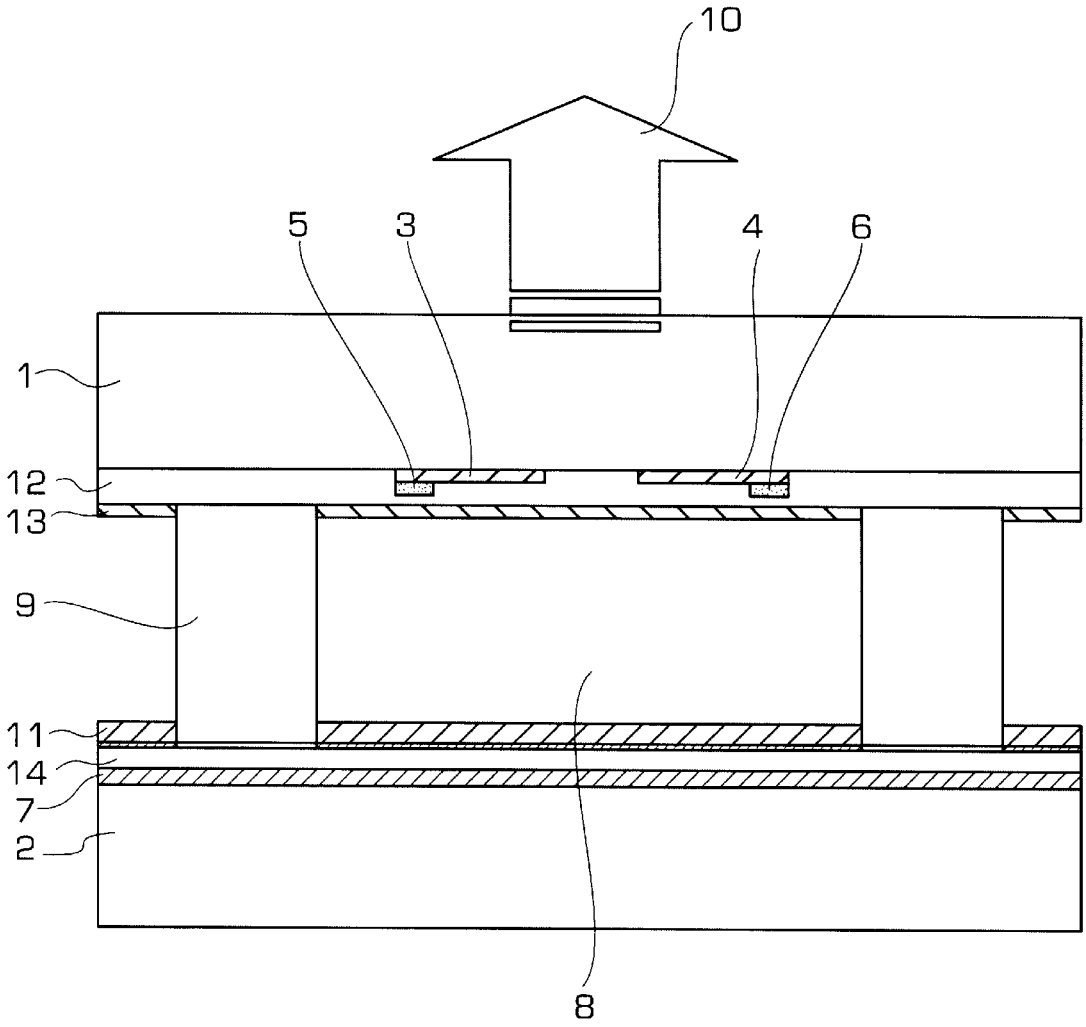
FIG. 1 PRIOR ART
FIG. 1 is a sectional view of the structure of an AC-drive surface discharge plasma display panel.
Figure 2:
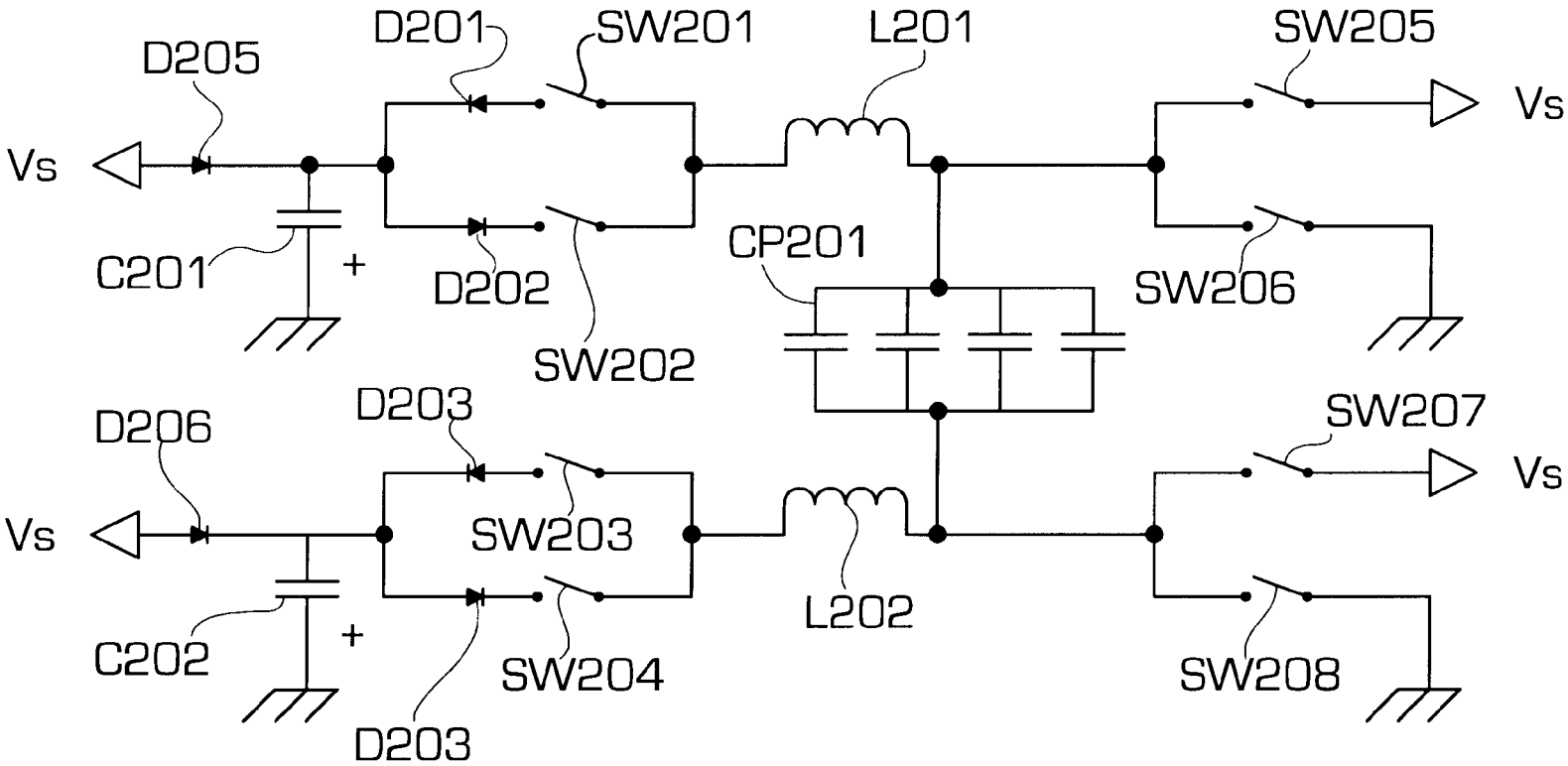
FIG. 2 PRIOR ART
FIG. 2 is a circuit diagram for explaining the power recovery of the first example of the prior art.
Figure 3:
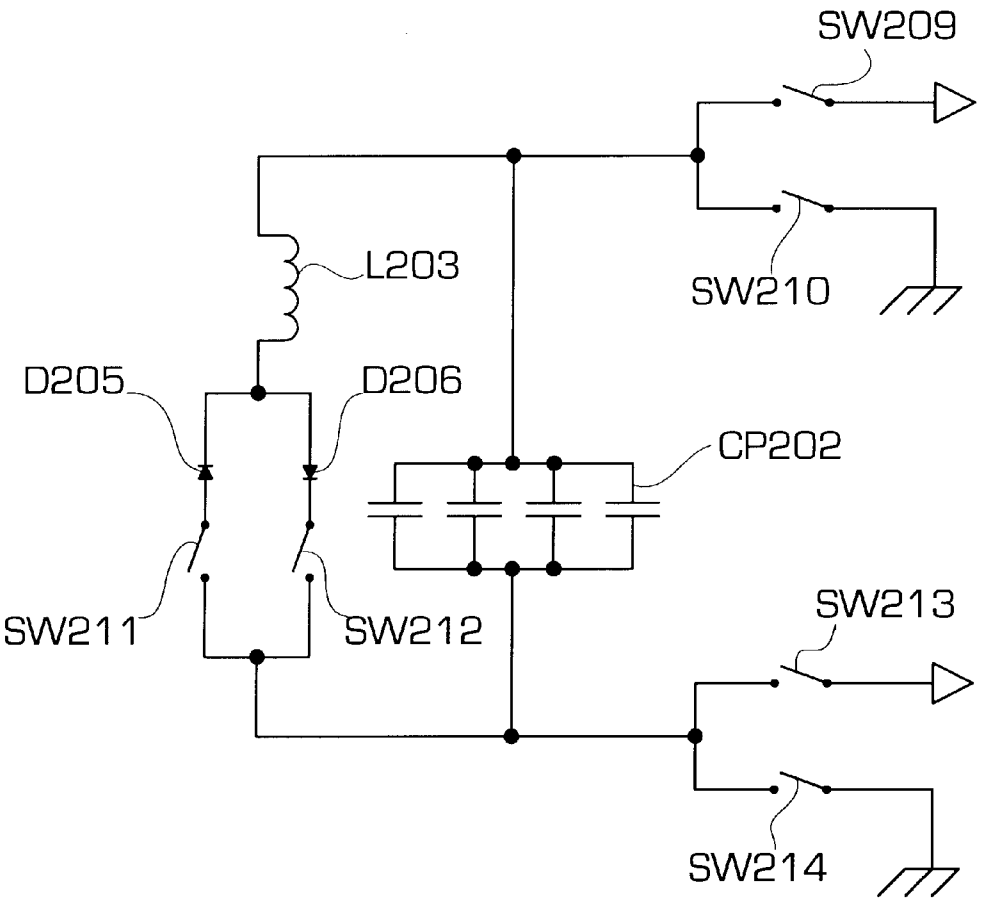
FIG. 3 PRIOR ART
FIG. 3 is a circuit diagram for explaining the power recovery of the second example of the prior art.
Figure 4:
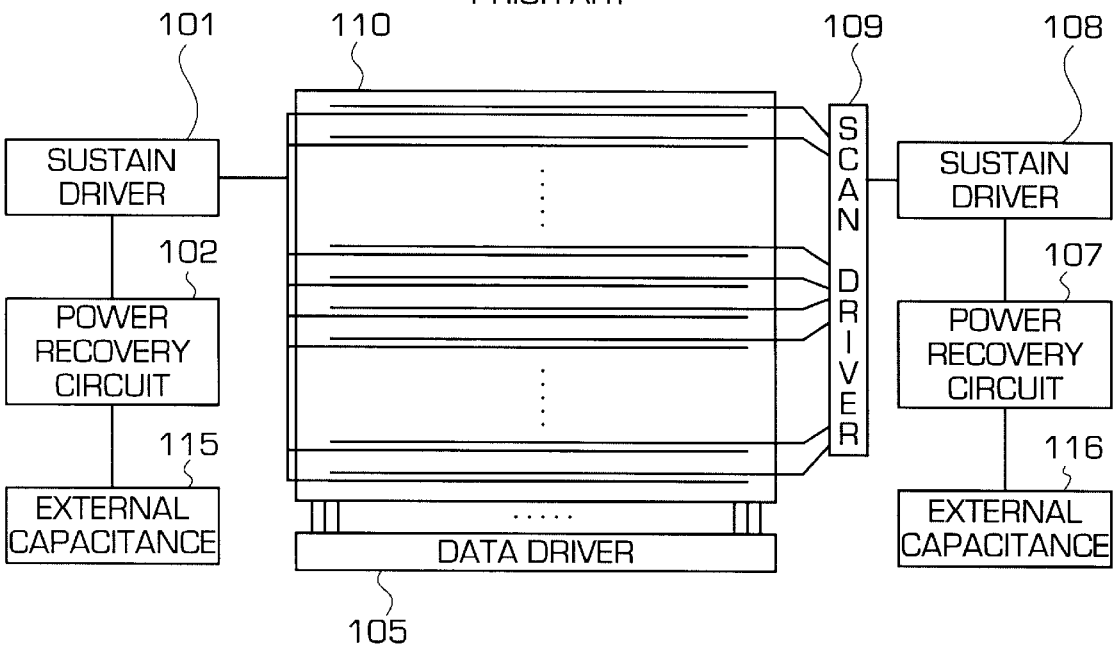
FIG. 4 PRIOR ART
FIG. 4 is a schematic view of the plasma display device in which the first example of the prior art is connected to a plasma display panel.
Figure 5:
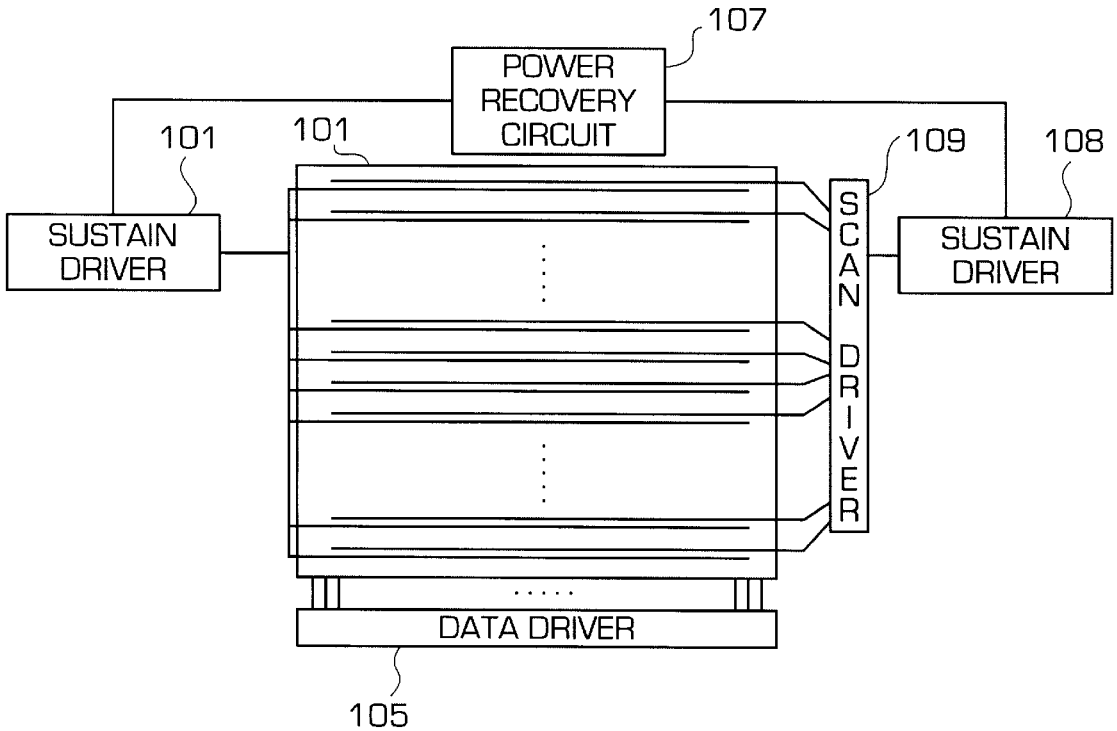
FIG. 5 PRIOR ART
FIG. 5 is a schematic view of a plasma display device in which the second example of the prior art is connected to a plasma display panel.
Figure 6:
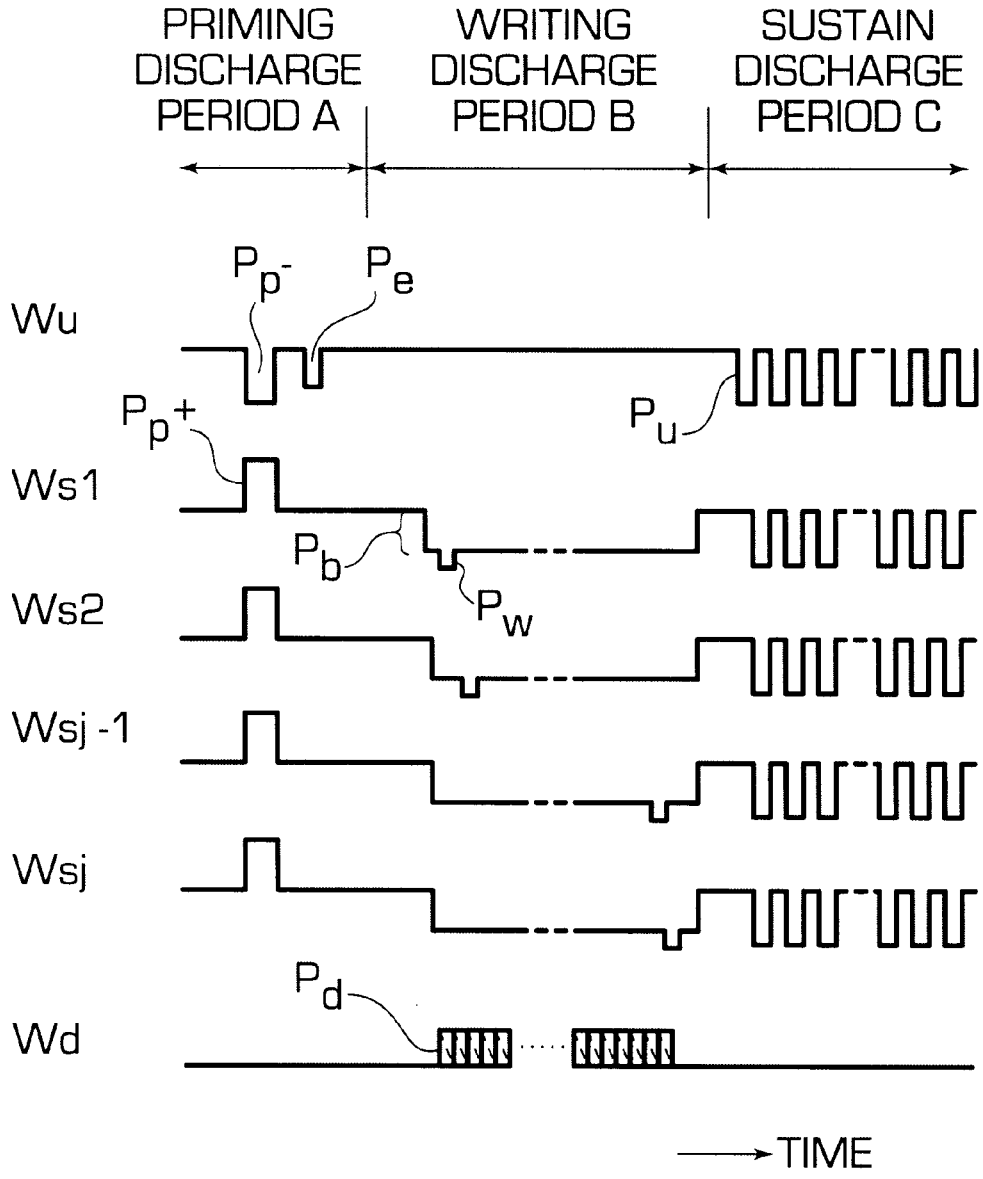
FIG. 6 PRIOR ART
FIG. 6 shows one example of a voltage waveform for driving a plasma display panel.
Figure 13:
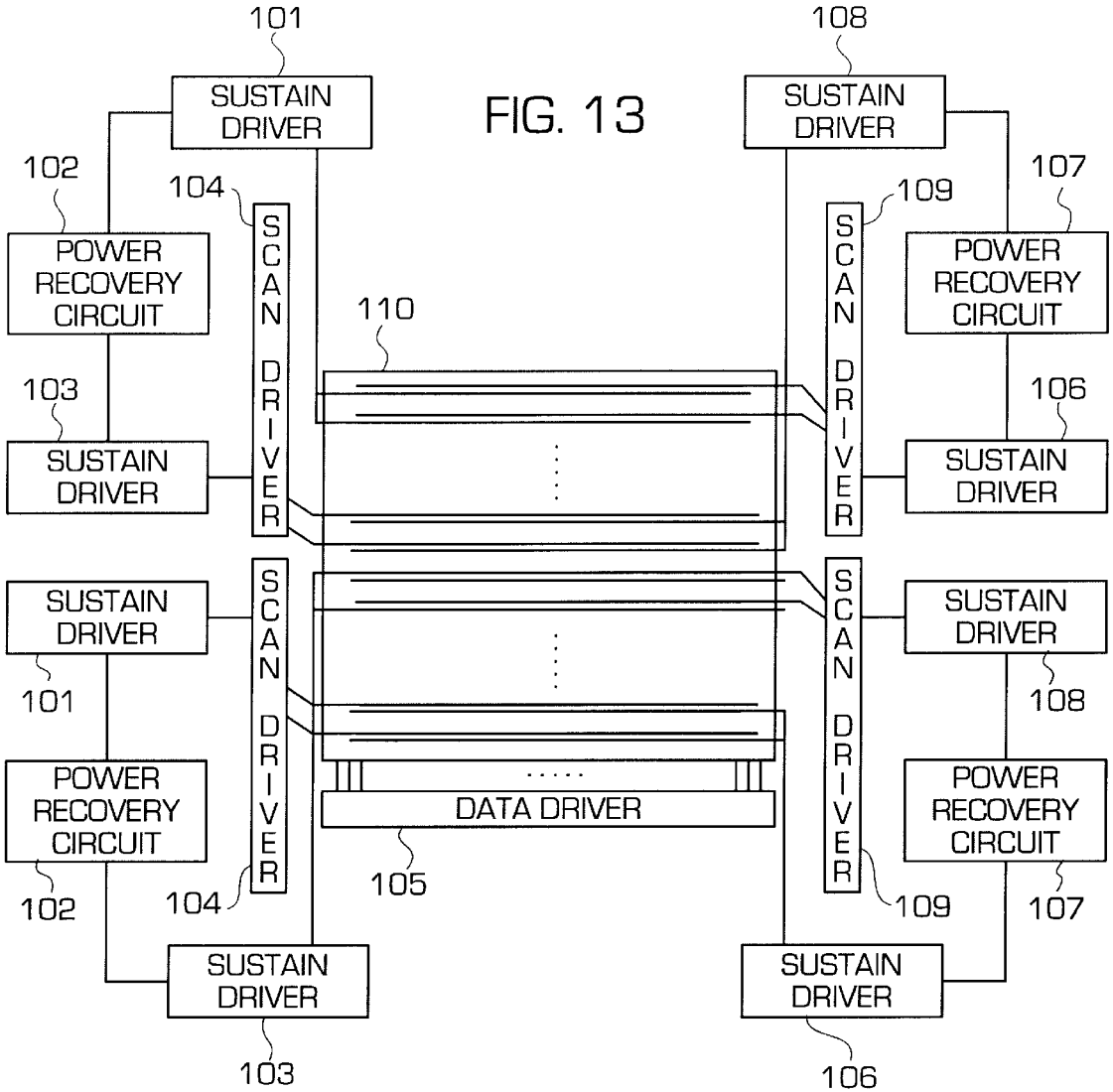
FIG. 13 is a schematic view of the plasma display panel display device according to the third embodiment of the present invention.
Figure 14:
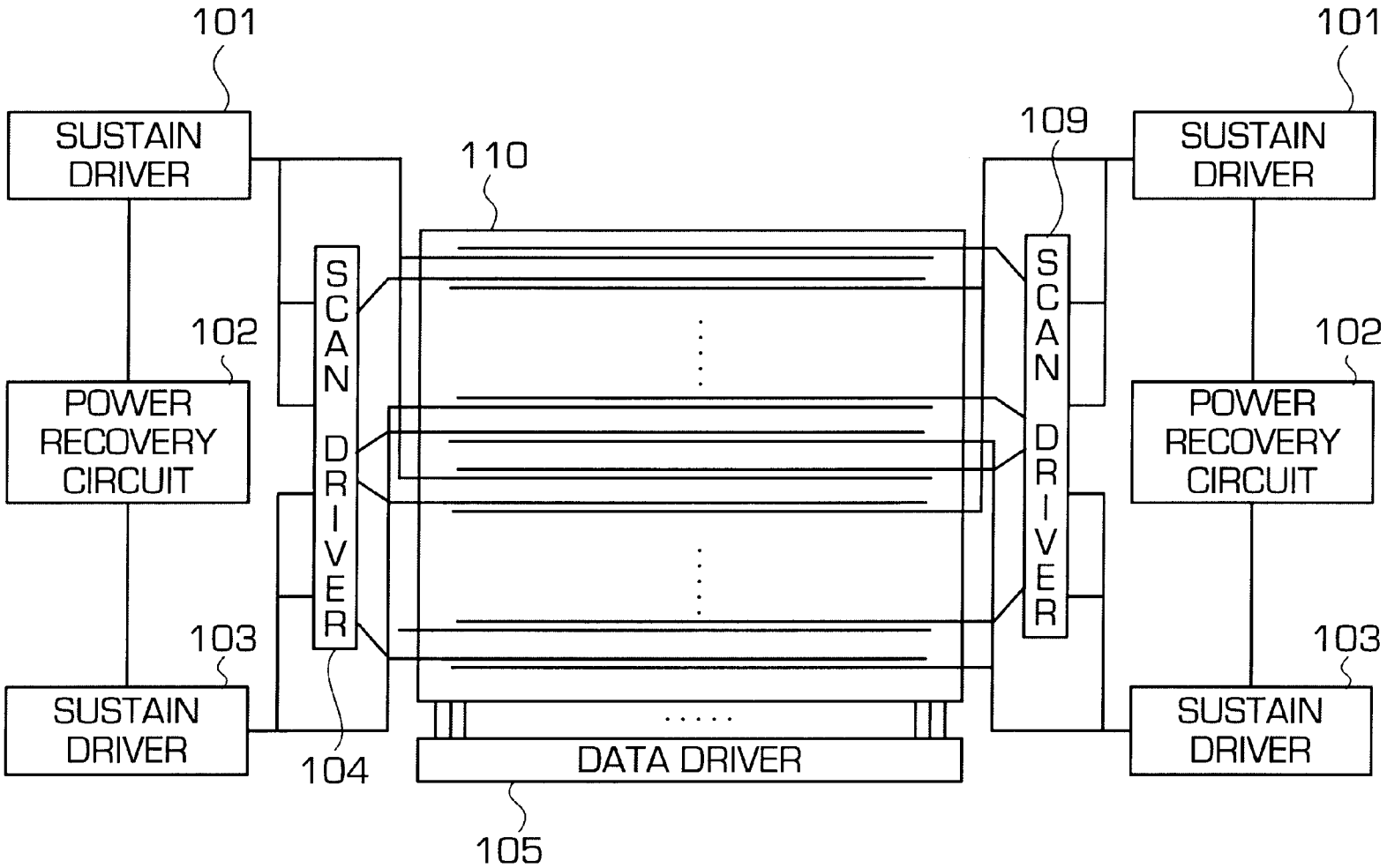
FIG. 14 is a schematic view of the plasma display panel display devices according to the fourth embodiment of the present invention.

FIG. 13 shows a schematic view of the third embodiment of the present invention. Thus far, explanation has been limited to divisions into two portions, but an equivalent effect can be obtained by dividing the panel capacitance by $2^n$ (n being a natural number) with two each of regions of display load pairs having the same capacitance, and then forming $2^{n-1}$ resonant circuits. For example, FIG. 13 shows a case of using two sets of the first embodiment shown in FIG. 11 with the resonant circuits that carry out the recovery operation composed of two independent closed circuits. Dividing the panel capacitance into multiple divisions entails an increase in the number of circuit components, but multiple division is employed in cases of insufficient current capacity of circuits in panels having large areas or when the voltage pulse form is modified in drive design. In particular, the form of voltage pulses is determined by the panel capacitance and the coils of the resonant circuits, and multiple divisions must be used in cases in which control cannot be achieved by a fixed number of circuit components alone. Regarding a multiple division method, the fourth embodiment of the present invention shown in FIG. 14 is one example in which the second embodiment shown in FIG. 12 is made a plurality of circuits and the number of panel region divisions is increased. Although drive can be effected in the first embodiment, the second embodiment, and the third embodiment with the voltage waveform shown in FIG. 6, this embodiment requires a modification of the drive waveform.

Figure 16:
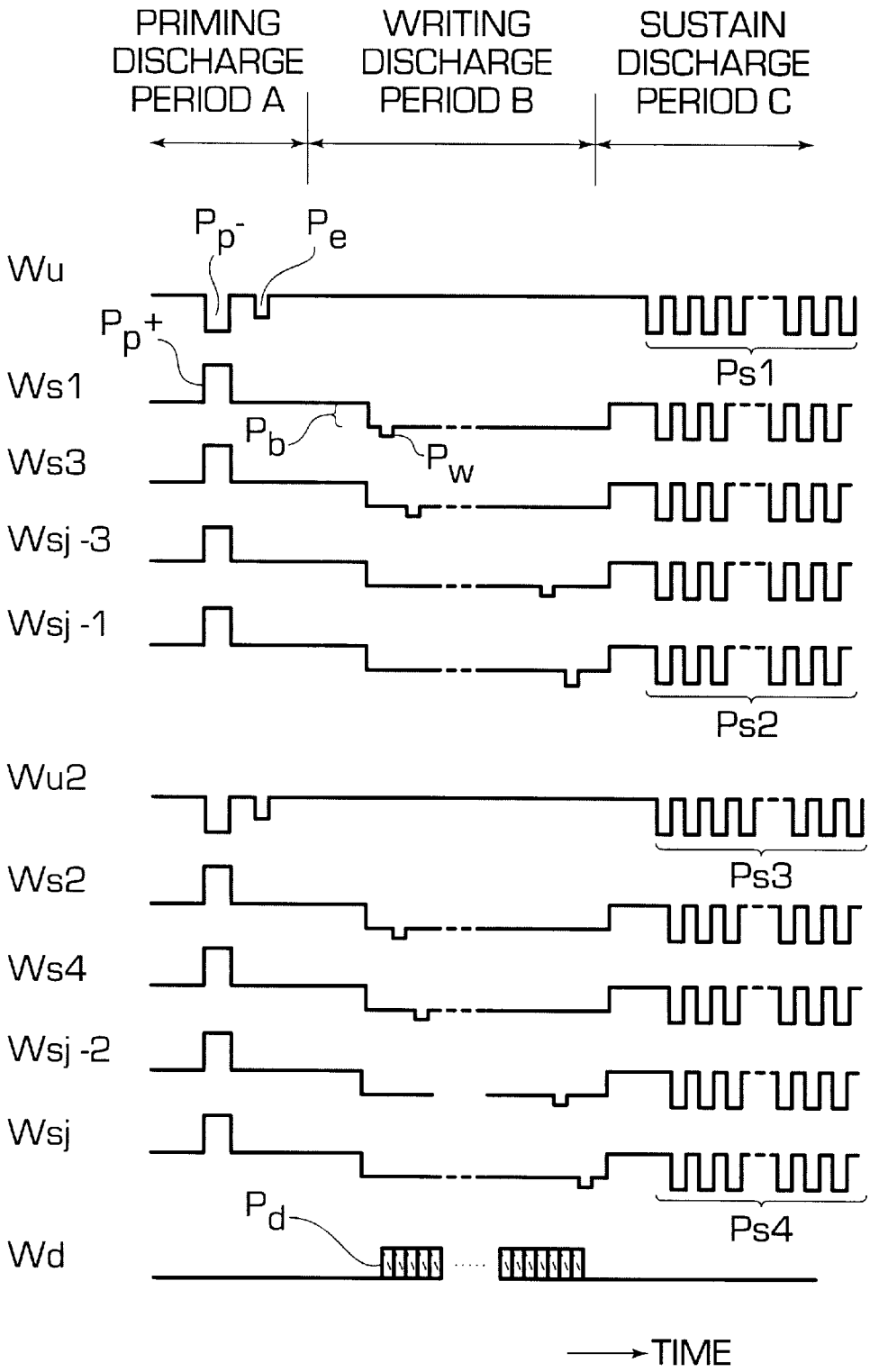
FIG. 16 shows one example of voltage waveform for driving the fourth embodiment.

FIG. 16 is a waveform chart of the drive waveform in the fourth embodiment. The drive waveform for the priming and scan intervals is similar to that of the first to third embodiments, but a first sustain pulse string Ps1 is applied to the first sustain electrode group of surface discharge electrode pairs that have been divided into two portions, and a second sustain pulse string Ps2 having a phase delayed by 180 degrees from the first sustain pulse string is applied to the first scan electrode group that is paired with these sustain electrode pairs. Third sustain pulse string Ps3 of the same phase as the second sustain pulse string is applied to the second sustain electrode group, and a fourth sustain pulse string Ps4 of the same phase as the first sustain pulse string Ps1 and having a pulse start that is delayed one period from Ps1 is applied to the first scan electrode group that is paired with the second sustain electrode group. The potential of adjacent electrodes between surface discharge electrodes is thus the same, and this feature not only allows prevention of erroneous discharge caused by the spread of discharge toward the vertical direction from selected cells during the sustain interval, but also has the effect of reducing electric field noise because the potential difference between surface discharge electrode pairs during the sustain interval inverts for every other pair.

Figure 15:
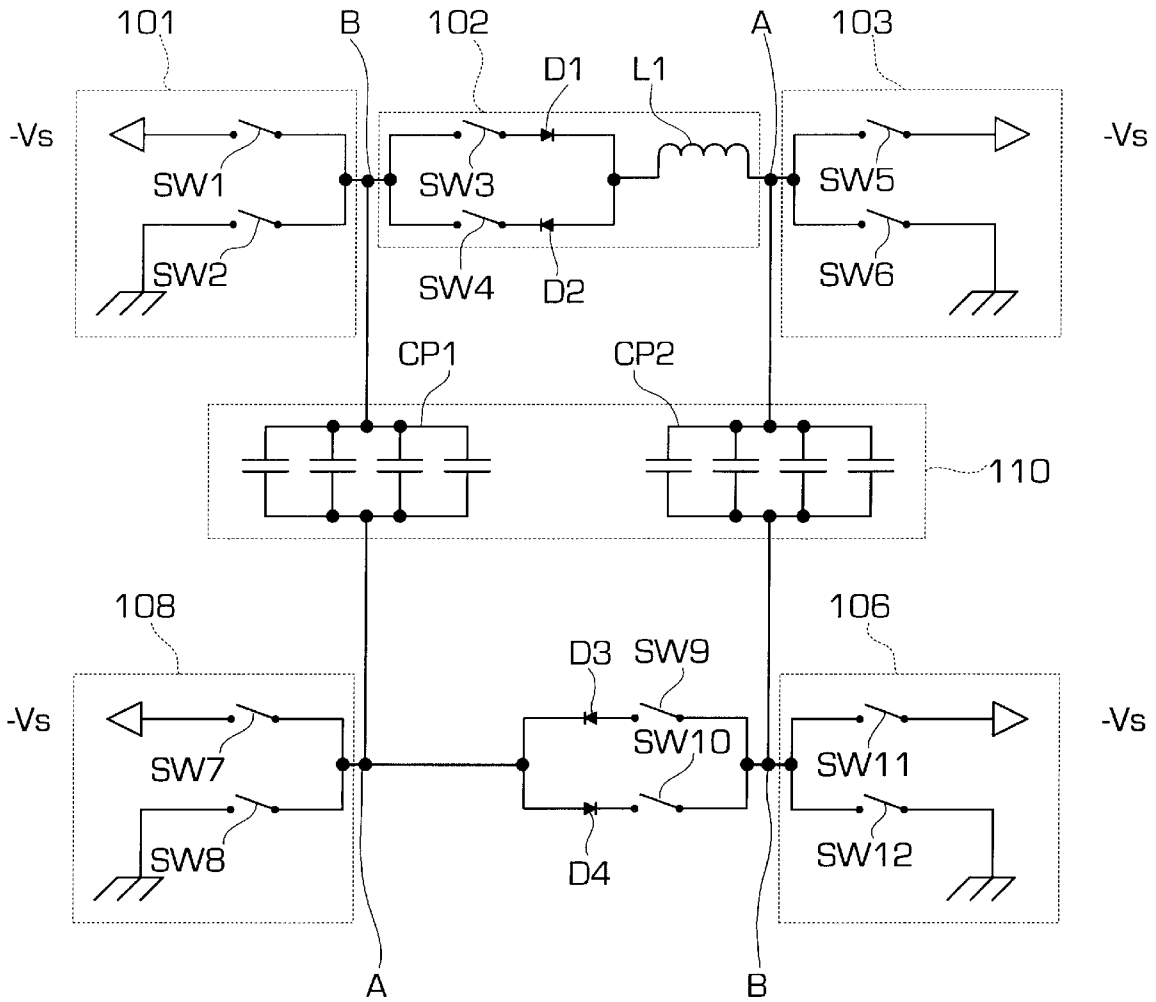
FIG. 15 is a circuit diagram of another example of a circuit for realizing power recovery of capacitive load in the present invention.

In addition, as shown in FIG. 15, one resonant circuit unit does not necessarily require two coils, one coil being sufficient for bringing about resonance.

In the explanation thus far, MOSFETs have been used as the switches that generate sustain pulses by switching high voltage and ground as well as the switches that switch current direction during resonance, but switch elements other than FETs, such as bipolar transistors and thyristors, may also be used as switches.

Although explanation in the above-described embodiments has related to panel capacitance that is clamped to a voltage level of ground and minus potential (voltage −Vs), it goes without saying that the voltage level is not limited to these values and may be clamped to ground and plus potential (voltage +Vs). In such a case, positive voltage can be substituted for ground and ground can be substituted for negative voltage in the circuit diagrams that show the gist of power recovery for the sustain pulses in this invention. The same effect is obtained if the clamp voltage is positive voltage and negative voltage (+Vs/2, −Vs/2), and plus voltage may be substituted for ground.

While preferred embodiments of the present invention have been described using specific terms, such description is for illustrative purposes only, and it is to be understood that changes and variations may be made without departing from the spirit or scope of the following claims.

What is claimed is:

1. A plasma display panel drive method in a plasma display panel comprising a plurality of surface discharge electrode pairs made up of scan electrodes and sustain electrodes that are parallel in the row direction and connected in the column direction, a plurality of data electrodes that are parallel in the column direction and connected in the row direction and that form pixels at the intersections with said surface discharge electrode pairs, and voltage input terminals of said scan electrodes and said sustain electrodes that make up pairs on opposing panel end portions of the same flat surface; whereby voltage pulses are periodically supplied that produce a first voltage state and second voltage state between said plurality of surface discharge electrodes pairs, the potential difference of said first voltage state being the reverse of the potential difference of said second voltage state; wherein regions of said plurality of surface discharge electrode pairs are divided such that the electrostatic capacitance between surface discharge electrode pairs is divided into $2^n$ equal portions, where n is a natural number;

$2^{n-1}$ series resonant circuits are formed by the electrostatic capacitance of two each of the divided surface discharge electrode pair regions, a coil, and a plurality of switches; and said first voltage state and second voltage state are shifted by said series resonant circuit.

2. A plasma display panel drive method according to claim 1 wherein one row or more of surface discharge electrode pairs connected in the column direction are made one set, and said surface discharge electrode pair sets are divided between even-numbered sets and odd-numbered sets.

3. A plasma display panel drive method according to claim 1 or claim 2 wherein, in said series resonant circuit, wiring to be connected to electrostatic capacitance of two divided surface discharge electrode pair regions with an interposed coil is connected to a voltage input terminal at the same panel end portion.

4. A plasma display panel drive circuit for a plasma display panel comprising a plurality of surface discharge electrode pairs made up of scan electrodes and sustain electrodes that are parallel in the row direction and connected in the column direction, a plurality of data electrodes that are parallel in the column direction and connected in the row direction and that form pixels at the intersections with said surface discharge electrode pairs, and voltage input terminals of said scan electrodes and said sustain electrodes that make up pairs on opposing panel end portions of the same flat surface;

wherein the regions of said plurality of surface discharge electrode pairs are divided such that electrostatic capacitance between surface discharge electrode pairs is divided into $2^n$ equal portions, where n is a natural number, and $2^{n-1}$ sets of series resonant circuits are formed that include the electrostatic capacitance of two each of the divided surface discharge electrode pair regions, a coil, and a plurality of switches, and that periodically supply voltage pulses that produce a first voltage state and second voltage state wherein the potential difference of two each of the divided surface discharge electrode pair regions is reversed.

5. A plasma display panel drive circuit according to claim 4 wherein each of said series resonant circuits comprises:

a first series-parallel circuit in which a first diode and a first switch element connected together in a series, and a second diode and a second switch element connected together in a series, are connected together in parallel, and in which the direction of current flow in said first diode is the reverse of the direction of current flow in said second diode; and a second series-parallel circuit in which a third diode and a third switch element connected together in a series, and a fourth diode and a fourth switch element connected together in a series, are connected together in parallel, and in which the direction of current flow in said third diode is the reverse of the direction of current flow in said fourth diode;

wherein a first end of said first series-parallel circuit is connected via a first wiring to a first electrode of a first electrostatic capacitance of two divided surface discharge electrode pair regions, a second end of said first series-parallel circuit is connected via a second wiring to a first electrode of a second electrostatic capacitance, a first end of said second series-parallel circuit is connected via a third wiring to a second electrode of said first electrostatic capacitance, and a second end of said second series-parallel circuit is connected via a fourth wiring to a second electrode of said second electrostatic capacitance, and a coil is provided that is connected to at least one of said first wiring to said fourth wiring.

6. A plasma display panel display device wherein the region of a plasma display panel is divided in the row director into a first panel region and a second panel region such that the capacitances of the two regions are equal, comprising:

first and third sustain drivers connected to common sustain electrode terminals of said first and second panel regions, respectively;

first and second scan drivers connected to scan electrode terminals of said second and first panel regions, respectively;

second and fourth sustain drivers connected to first and second scan drivers, respectively; and first and second power recovery circuits including coils and switches and are connected between said first and second sustain drivers and between said third and fourth sustain drivers, respectively.

7. A plasma display panel display device wherein sets of surface discharge electrode pairs connected in the column direction are divided into two portions of odd-number rows and even-numbered rows, comprising:

first and second sustain drivers connected to common sustain electrode terminals of surface discharge electrode pairs of even-numbered rows and surface discharge electrode pairs of odd-numbered rows, respectively;

first and second scan drivers connected to scan electrode terminals of surface discharge electrode pairs of even-numbered rows and surface discharge electrode pairs of odd-numbered rows, respectively;

third and fourth sustain drivers connected to said first and second scan drivers, respectively; and first and second power recovery circuits including coils and switches, and connected between said first and third sustain drivers and between said second and fourth sustain drivers, respectively.

8. A plasma display panel display device wherein a region of surface discharge electrode pairs is divided into a first region and a second region such that the electrostatic capacitance between surface discharge electrodes in the two regions is equal, comprising:

first and second scan drivers connected to scan electrode terminals of said first and second regions, respectively;

first and second sustain drivers connected to common sustain electrode terminals of said first scan driver and said first region, respectively;

third and fourth sustain drivers that are connected to common sustain electrode terminals of said second scan driver and said second region, respectively; and first and second power recovery circuits that are made up of switches and coils and that are connected between said first and second sustain drivers and between said third and fourth sustain drivers, respectively;

wherein a first sustain pulse train is applied to the group of sustain electrodes of said first region, and a second sustain pulse train having phase shifted 180° from that of said first sustain pulse train is applied to the group of scan electrodes of said first region; and a third sustain pulse train having the same phase as said second sustain pulse train is applied to the group of sustain electrodes of said second region, and a fourth sustain pulse train having the same phase as said first sustain pulse train and a pulse start that is delayed one period from said first sustain pulse train is applied to the group of scan electrodes of said second region.

* * * * *